US006109007A

United States Patent [19]

Combs et al.

[11] Patent Number: 6,109,007

[45] **Date of Patent: *Aug. 29, 2000**

[54] SINGLE STATION FOOD PRODUCT WRAPPING APPARATUS AND METHOD FOR MAKING UP A ONE POUND PACKAGE

[75] Inventors: Timothy F. Combs, Lambertville; James O. Byrd, Monroe, both of Mich.

[73] Assignee: Tru Pac Inc., Ida, Mich.

[ * ] Notice: This patent is subject to a terminal disclaimer.

[21] Appl. No.: 09/261,091

[22] Filed: Mar. 2, 1999

[51] Int. Cl.[7] ..... B65B 11/00; B65B 11/48; B65B 11/06

[52] U.S. Cl. ..... 53/466; 53/460; 53/223; 53/228

[58] Field of Search ..... 53/201, 202, 466, 53/464, 460, 461, 401, 222, 223, 221, 228, 122

[56] References Cited

U.S. PATENT DOCUMENTS

| | | | |
|---|---|---|---|
| 1,064,964 | 6/1913 | Dooley | 53/222 |
| 1,129,975 | 3/1915 | Giroud | 53/222 |
| 1,458,977 | 6/1923 | Escobales | 53/464 |
| 1,858,189 | 5/1932 | Downing | 53/222 |
| 2,094,402 | 9/1937 | Grover | 53/222 |
| 2,100,739 | 11/1937 | Gilfillan | 53/222 |
| 3,266,214 | 8/1966 | Kramme | 53/122 |
| 3,452,515 | 7/1969 | Bongartz et al. | 53/222 |
| 3,583,603 | 6/1971 | Freckman et al. | 222/137 |
| 3,688,468 | 9/1972 | Erekson | 53/122 |
| 3,864,891 | 2/1975 | Piereder | 53/122 |
| 3,979,021 | 9/1976 | Reinecke | 141/248 |
| 4,505,311 | 3/1985 | Kramer et al. | 141/392 |
| 4,667,709 | 5/1987 | Fischer et al. | 141/258 |
| 4,750,531 | 6/1988 | Juenkersfeld et al. | 141/1 |
| 4,860,926 | 8/1989 | Juenkersfeld et al. | 141/258 |
| 4,964,545 | 10/1990 | Mooshammer | 141/234 |
| 5,159,959 | 11/1992 | Bohm | 53/502 |
| 5,379,574 | 1/1995 | Fischer et al. | 53/222 |
| 5,794,411 | 8/1998 | Combs et al. | 53/466 |

*Primary Examiner*—Brian L. Johnson
*Assistant Examiner*—Matthew Luby
*Attorney, Agent, or Firm*—John R. Benefiel

[57] ABSTRACT

A food product wrapping apparatus and method, in which four sticks of food product are simultaneously molded and wrapped during each cycle of operation, using a four cavity set mold plate and four cavity wrapping machines. A shuttle plate has two sets of four cavities and is alternately moved into a dosing mold for filling of one set of cavities and thence over a respective four cavity wrapping machine. All four sticks are simultaneously pushed out of the mold cavities and thereaft through the wrapping machine cavities.

2 Claims, 7 Drawing Sheets

SINGLE STATION FOOD PRODUCT WRAPPING APPARATUS AND METHOD FOR MAKING UP A ONE POUND PACKAGE

BACKGROUND OF THE INVENTION

This invention concerns wrapping of pasty or moldable food products such as butter or margarine. Butter and margarine are commonly molded into quarter pound or one pound pieces in the form of elongated blocks referred to as sticks. The product sticks are then individually wrapped in grease impervious printed sheets prior to being packaged four to a package in paper cartons.

Wrapping of the individual product sticks is done by automated machinery in a multistage operation.

The wrapped sticks are then conveyed to a packaging machine which may also be included in the same apparatus, where four wrapped sticks are gathered to make up a one pound package.

Heretofore, the molding and wrapping operation have been conducted in a series of separate stations in the machine with transport of the product and sheet successively through a number of individual stations. Such transport is by a large carrier disc, operated with a geneva wheel motion or with a linear conveyor. In each station, a portion of the steps required to complete the product wrapping operation is carried out.

In applicant's U.S. Pat. No. 5,794,411 issued on Aug. 18, 1998, a single station simplified food product wrapping machine is disclosed and claimed.

That machine uses a single folding frame which may have a series of rectangular through cavities, one cavity for each stick to be wrapped within the folding frame. Each cavity has associated therewith a series of cam and pusher devices which act on a sheet of wrapping paper as the wrapping paper is pushed through the cavity with the food stick to be wrapped such as to execute successive folding operations which result in a fully wrapped stick, which is pushed out of the cavity by the advance of the next wrapped stick.

The first camming device comprises a pair of flat rectangular blades projecting towards the cavity from each end with a clearance gap on either side of the flat blades between the sidewall of the top the folding frame. As the sheet is pushed into the cavity, the central portion of either end of the sheet is bent upwardly towards the stick end and a pair of fold wings are simultaneously formed which pass through respective gaps allowing the food stick and sheet to advance into the cavity.

A pair of chisel pointed folding cams are located on either side of the cavity, the folding cams projecting horizontally and forwardly spaced apart. The respective fold wings successively encounter the spaced cam fingers which fold the wing folds in overlapping fashion against each end of the food stick as the food stick is advanced to the bottom of the folding frame cavity.

A pair of rectangular folding blades is then advanced through slots so as to enter the cavity at a level aligned with the top of the food stick engaging the folded sheets so as to again force the sheet central regions onto the top of the folding stick, each forming opposite top wing folds which project upwardly into the cavity against upwardly projecting flaps on either side of the sheet.

A pair of top flap folding plates are recessed into the sidewall of the cavity at a level even with the top of the food stick when the food stick has been fully advanced to the bottom of the cavity. Each of the folding plates are successively pivoted into the cavity folding each top flap atop the food stick.

The next successive food stick forces the completely folded food stick out of the cavity and onto a conveyor.

While this arrangement has simplified the wrapping process, another drawback of prior wrapping machines, particularly for butter and margarine is that only one or two sticks are wrapped at a time. Four sticks are required for the typical one pound package. Thus, by wrapping only one or two sticks at a time, it takes longer to make up a one pound package, and four wrapped sticks must be processed to complete a one pound package.

It is the object of the present invention to provide a wrapping machine in which four wrapped quarter pound sticks are produced simultaneously to allow a one pound package to be made up more rapidly than with prior art machines.

SUMMARY OF THE INVENTION

The above recited object is achieved by arranging two spaced apart sets of four mold cavities in a mold shuttle plate, which is moved back and forth through a product dosing mold. Each mold cavity set is alternately filled with product in the dosing mold and then moved out over a respective folding machine, aligned with an array of four folding frame cavities in the folding machine which is of the type claimed in U.S. Pat. No. 5,794,411.

All four product sticks are simultaneously forced out of the mold plate cavities and through the folding frame cavities to yield four wrapped product sticks, for making up a one pound package deposited on a conveyor with each cycle of the apparatus.

The mold shuttle plate is alternately positioned so that when one of the cavity sets is in the doser mold being filled, the other set is positioned over the respective set of folding frame cavities and the sticks therein are pushed out and wrapped. Four wrapped sticks are simultaneously deposited on a transport conveyor which each cycle of the apparatus.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 8A:
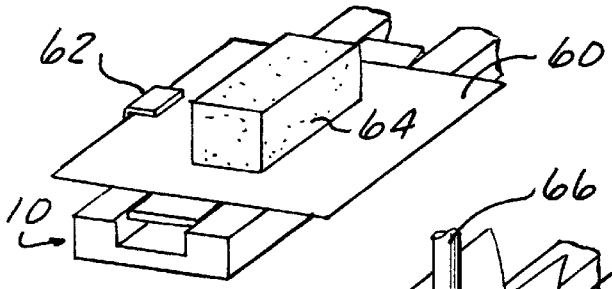
FIG. 8A–G are perspective illustrative views of the successive folding stages executed in the folding frame shown in FIGS. 1–7 together with a conveyor receiving the wrapped food product sticks for transport to the next operation.
Figure 8B:
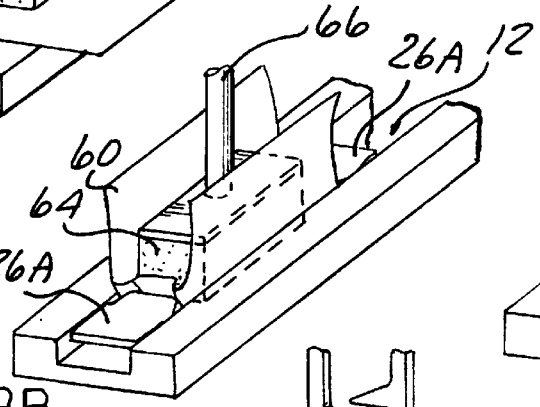
Figure 8C:
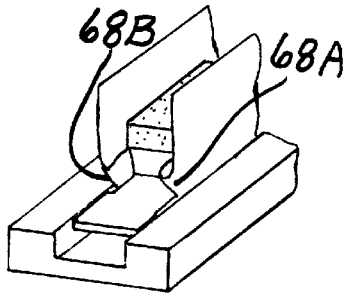

According to the concept of the present invention, the food stick wrapping is carried out in a folding frame 10 which is shown in FIGS. 1–7. The folding frame 10 is as a two cavity configuration for explanatory purposes, although four sticks will be wrapped simultaneously using four cavity folding frames, as described herein, as depicted in FIGS. 8 and 9.

Referring to FIGS. 1–7, the folding frame 10 provides a structure defining a pair of rectangular through cavities 12 extending through the folding frame. The rectangular cavity 12 is defined by an opening in top plate 14 and bottom plate 16 aligned with each other and spaced apart by sets of side plates 18A, 20A, 18B, 20B and sets of end plates 22A, 22B, 24A, 24B, respectively.

Figure 1:
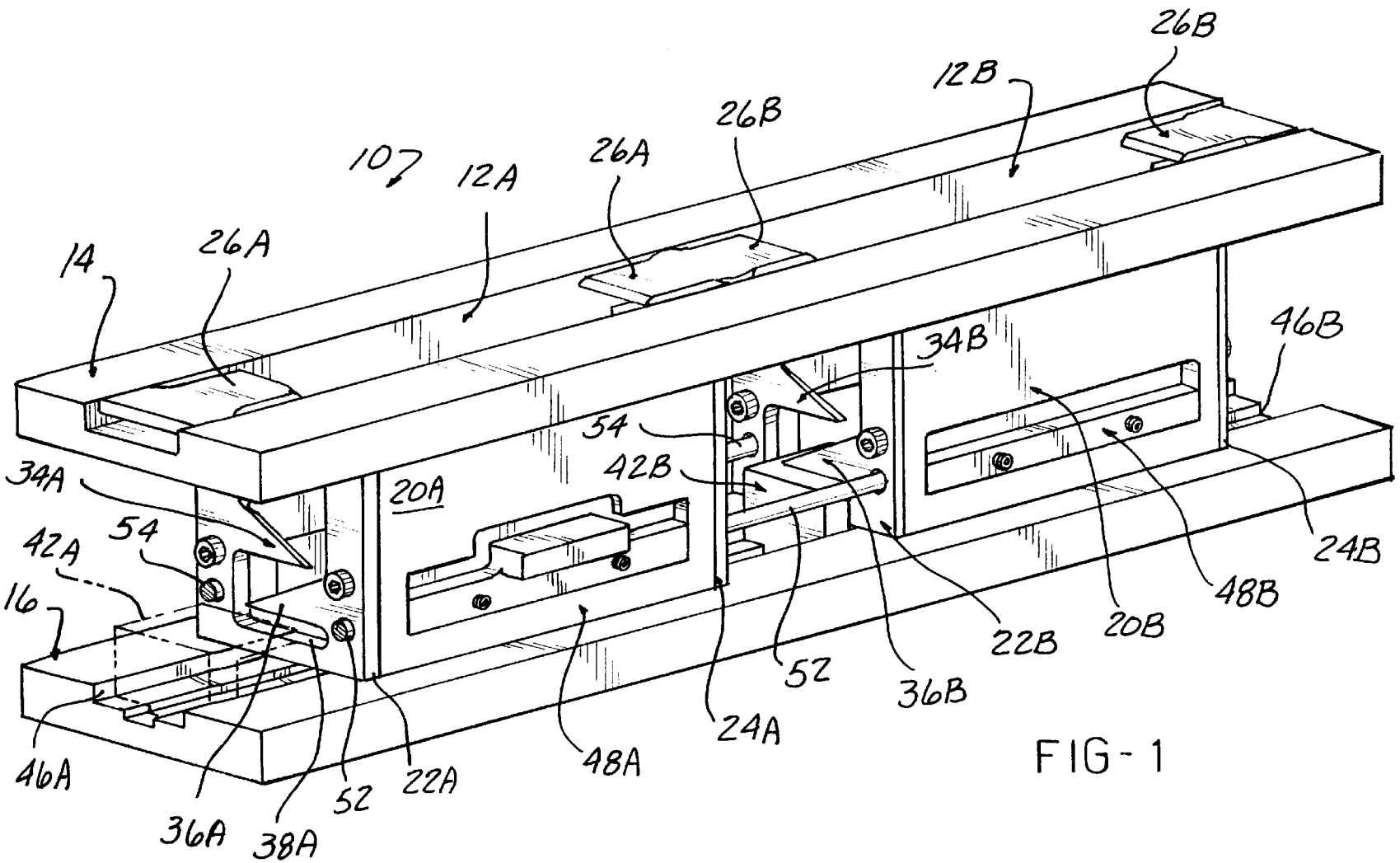
FIG. 1 is a perspective view of a dual cavity folding frame according to the present invention.

At the inner side of each cavity 12A, 12B is provided a fold forming flat blade 26A, 26B. The two adjacent blades 26A, 26B at the center can be made of a single piece as shown in FIG. 1.

Each of the blades 26A, 26B has a portion protruding into the respective cavities 12A, 12B to be overhung at the upper edge thereof.

Figure 2:
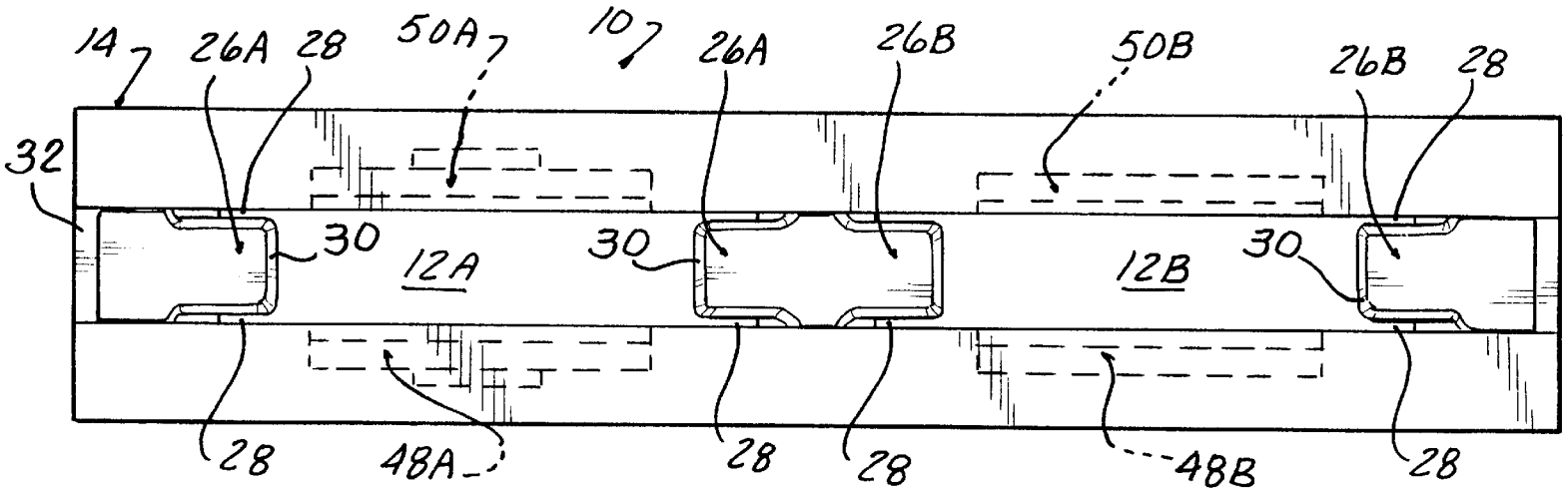
FIG. 2 is a plan view of the folding frame shown in FIG. 1.
Figure 3:
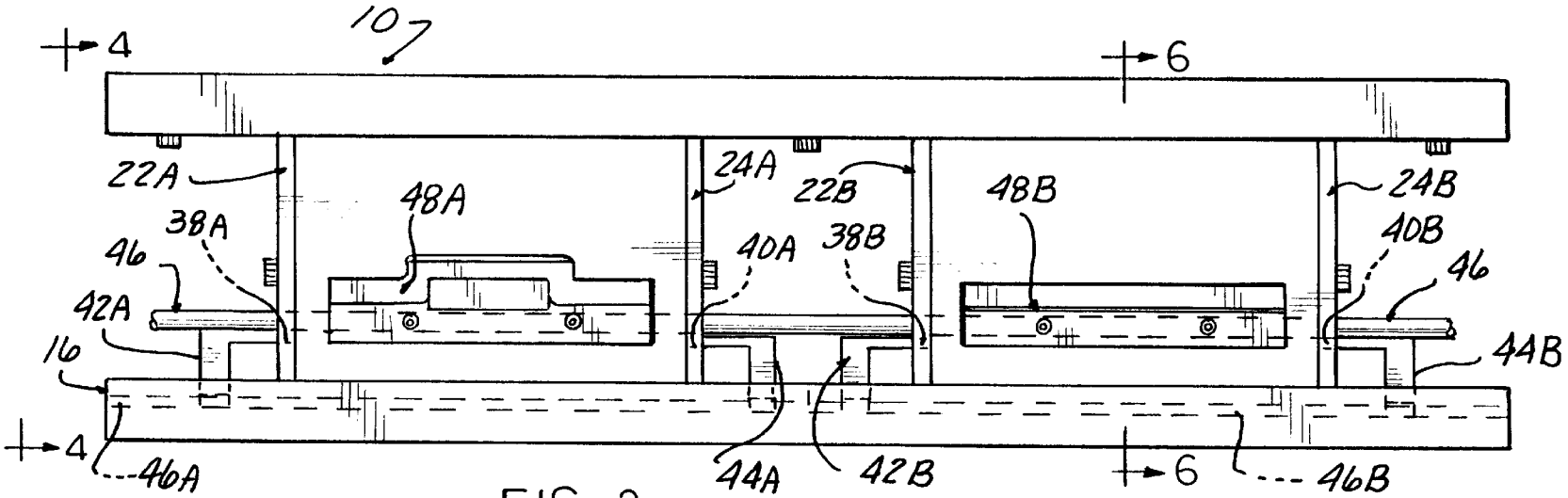
FIG. 3 is a side elevational view of the folding frame shown in FIGS. 1 and 2.
Figure 5:
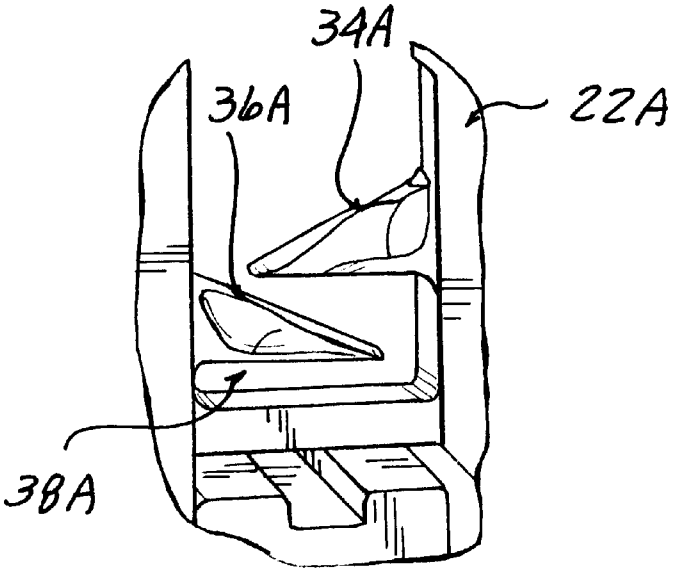
FIG. 5 is a fragmentary perspective end view of the cam fingers included at either end of the folding frame shown from the inside to reveal the contours thereof.
Figure 4:
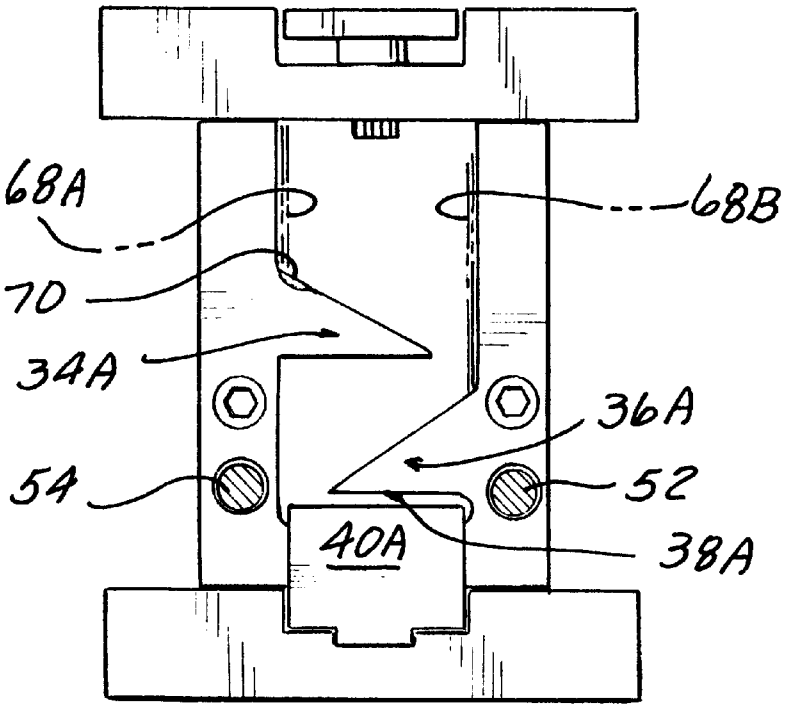
FIG. 4 is an end view taken in the direction of the lines 4—4 in FIG. 3.
Figure 7:
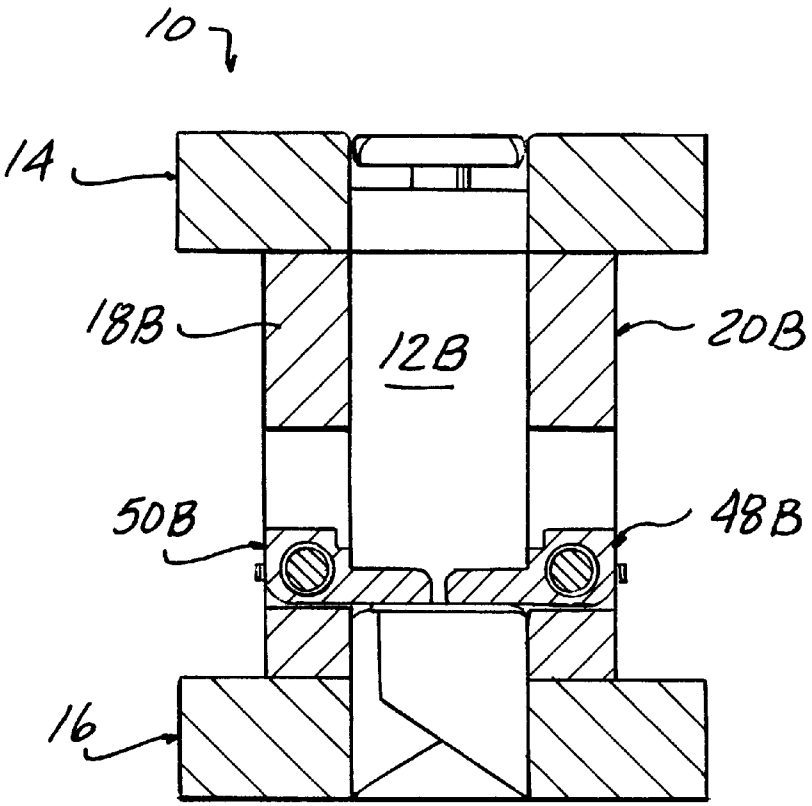
FIG. 7 is a transverse sectional view showing the folding plates in their full advanced folded pivoted position.
Figure 6:
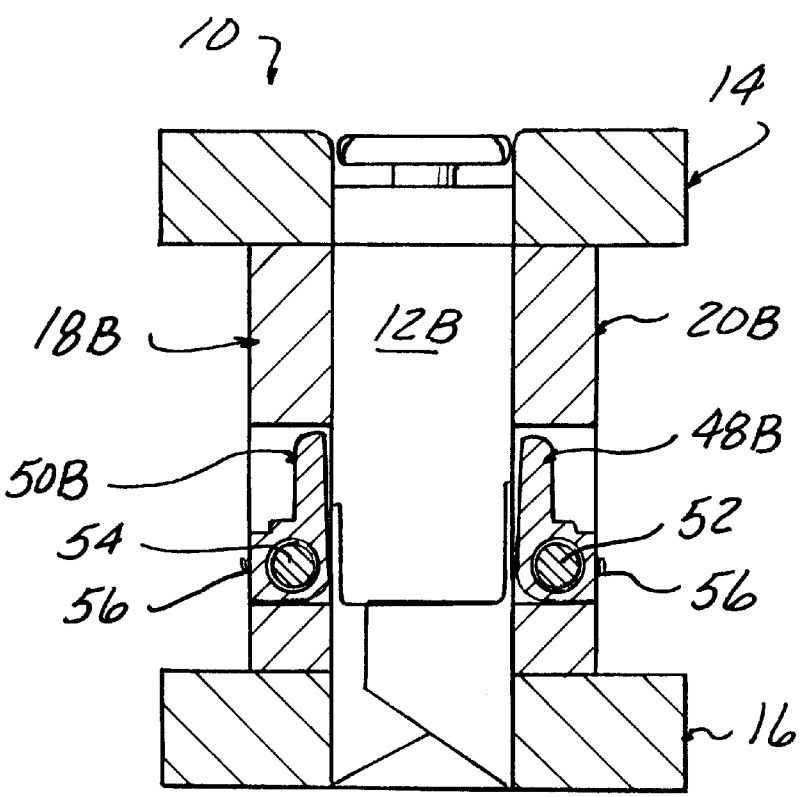
FIG. 6 is a transverse sectional view taken through the folding frame along the lines 6—6 in FIG. 3 with the top folding plate in the pivoted recessed position.

A clearance slot 28 is provided alongside the three side edges of each of the blades 26A, 26B. The top surface of the blades is also provided with a chamfered surface 30 extending about the perimeter thereof (FIG. 2).

The blades 26A, 26B are also recessed into the top of the upper plate 14 lying within a slot 32 (FIG. 2) extending across the top and entering into each of the cavities 12A, 12B so that the upper surface of the top plate 14 and the upper surface of the blades 26A, 26B are flush with each other.

Lying below the blades 26A, 26B are a pair of vertically spaced cam fingers 34A, 36A and 34B, 36B which extend toward each other but being vertically separated.

Below the cam fingers 34A, 36A, 34B, 36B are horizontal slots 38A, 40A, 38B, 40B in each end plate 22A, 22B, 24A, 24B adapted and sized to receive a flat inward projecting blade portion of pairs of slider shoes 42A, 42B, 44A, 44B which are slidably mounted in a guide track 46A, 46B formed in the upper surface of the bottom plate 16 aligned with the slots 38A, 40A, 38B, 40B. Recessed into the inner surface of each side plate 18A, 20A, 18A, 20B are pivoted top flap folding plates 48A, 50A, 48B, 50B which are pivotally supported on elongated rods 52 and 54 with set screws 56 allowing transmission of rotation from actuators powering rotation of the rods 52 and 54.

FIG. 8 illustrates the function of each of the above-described elements.

During the first step, a rectangular flat sheet of paper 60 is positioned atop the folding frame 10 properly located as with the stop 62. The rectangular stick of food product 64 is pushed as out of a mold cavity onto the sheet material 60.

A plunger 66 advances the food product stick 64 into the cavity 12A of the fixture forcing the paper down into the cavity as well.

The projecting flat blades 26A prevent the center end sections of the sheet 60 from advancing into the cavity 12A, thus constraining an upward folding of the sheet material towards the respective end face of the food stick 64.

As the action proceeds, the excess sheet material is directed into the slots 28 to form the wing folds which project away from the end face of the food product stick 64, as indicated to the right side in FIG. 8.

Continued advance of the food product stick 64 into the cavity 12A results in engagement of the wing fold 68 with each respective cam finger 34A and 36A. The bottom edge of the wing folds engage the surface of each folding finger 34A and 36A.

The upper folding finger 34A and lower folding finger 36A are each provided with rounded contours facing toward the inside of the cavity 12A and which lessens toward the outboard end of the respective cam finger such as to create a surface shape tending to cam the wing fold 38A, 38B toward each other so as to initiate the folding action rather than a tearing or shearing of the paper flap.

The surface contour of the upper shoe 34A is extended so as to create a slight pocket 70 which insures that tearing of the paper does not occur, reliably creating a comer as the wing fold 68A is cammed toward the end face of the product stick 64.

Figure 8D:
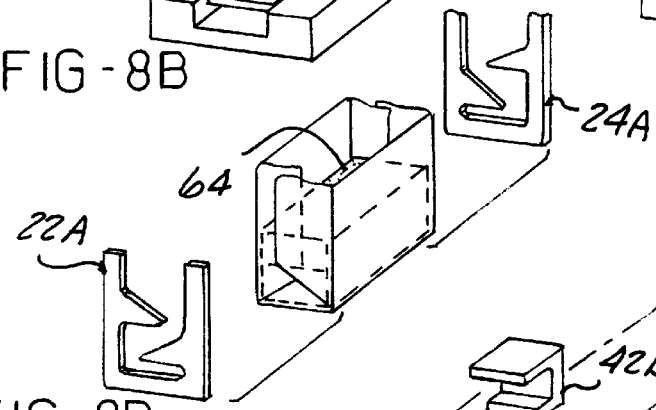
Figure 9:
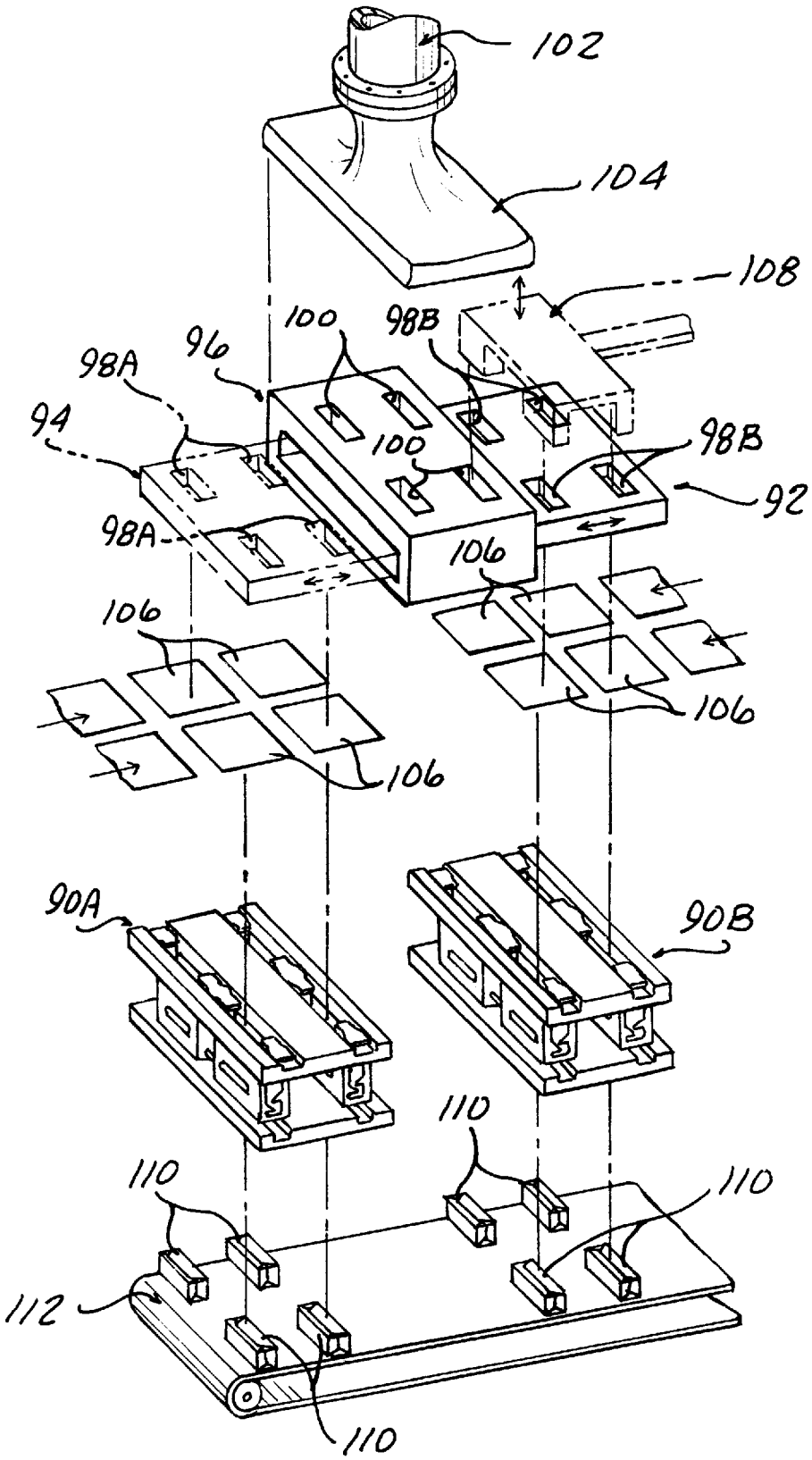
FIG. 9 is an exploded illustrative perspective view of a stick molding frame and nozzle, associated with a pair of found cavity folding frames and a transport conveyor.

The vertical spacing of the fingers 34A and 36A create a successive sequential folding action with the flaps 68A folded over the thence the wing fold 68B resulting in the intermediate folding stage shown in FIG. 8D.

Figure 8E:
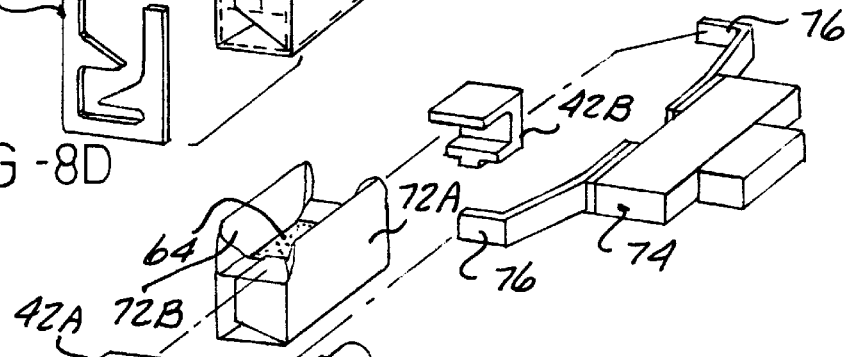
Figure 8F:
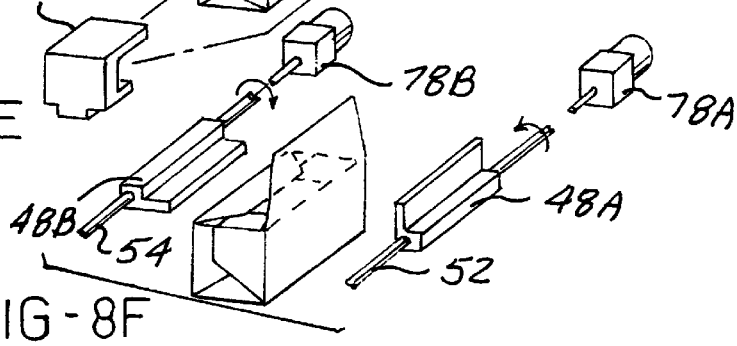

As shown in FIG. 8E, shoes 42A and 42B have their upper blade portion aligned with the top of the food product stick 64 such that when advanced through the respective slots in the end plates, the center portion of the upwardly projecting sheet material is folded downwardly against the top of the food product stick with a pair of wing folds formed at each comer in similar fashion to the initial wing fold formation shown in FIGS. 8B and 8C creating a pair of top flaps 72 extending longitudinally along the food product stick 64.

The advance of the shoes 42A and 42B towards each other to cause the upper blade portions to pass over the top of the food product stick 64 can be carried out by any suitable actuator. A gripper actuator 74 is shown in FIG. 8E which has a pair of fingers 76 which straddle the two sliding shoes 42A and 42B which are hydraulically or pneumatically advanced towards each other upon actuation and thence reversed to bring the shoes 42A and 42B back to their spaced apart withdrawn position.

Figure 8G:
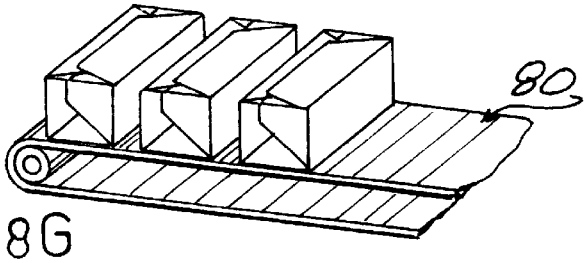

Finally, in FIG. 8G the top flaps 72A and 72B are successively folded downward atop the food stick by pivoting of the shafts 52 and 54 so as to cause the top folding plates 48A and 48B to be sequentially rotated out of the recess in the sidewall and fold the top flaps down with suitable rotary actuators 78 being used for this purpose.

The actuator shafts 52 and 54 extend between the top folding plate of each cell 12A and 12B of the folding frame 10.

It is noted that the paper is maintained in its folded position by contact with the food product in the case of butter or margarine. Each completely wrapped food product stick 64 is deposited on a conveyor 80 as shown in FIG. 8G as the next succeeding food product stick 64 is advanced into the cavity 12A and 12B to be pushed out of the cavity and onto the conveyor as indicated.

FIG. 9 shows the combination of a pair of four cavity folding frames 90A, 90B with a four cavity mold assembly 92 which includes a mold cavity shuttle 94 movable within a mold housing 96 to alternately position a respective grouping of four cavities 98A or 98B beneath ports 100, or a respective folding frame 90A or 90B.

The ports 100 are aligned with a product tube 102 and performer 104 through which food product is forced to fill the set of cavities 98A or 98B.

When one of the cavity sets 98A or 98B is being filled, the other is aligned over the respective folding frame 90A, 90B.

A sheet feeder (not shown) positions paper sheets 106 over the cavities in each frame 90A, 90B. A pusher 108 has fingers which simultaneously advance all four of the formed product sticks out of the mold cavities 98A, 98B and into the folding frame cavity.

The four wrapped sticks 110 are simultaneously deposited on a conveyor 112 with each cycle of the apparatus.

The four sticks 110 make up a one pound package, such that the rate of wrapping and packaging is greatly speeded up.

It is noted that the folding frames can be oriented either vertically or horizontally to suit the particular orientation.

Suitable spring loaded shoes (not shown) can be used to hold the product sticks in their folding cavity until pushed out by the next succeeding wrapped stick, in a manner well known in the art.

Figure 10:
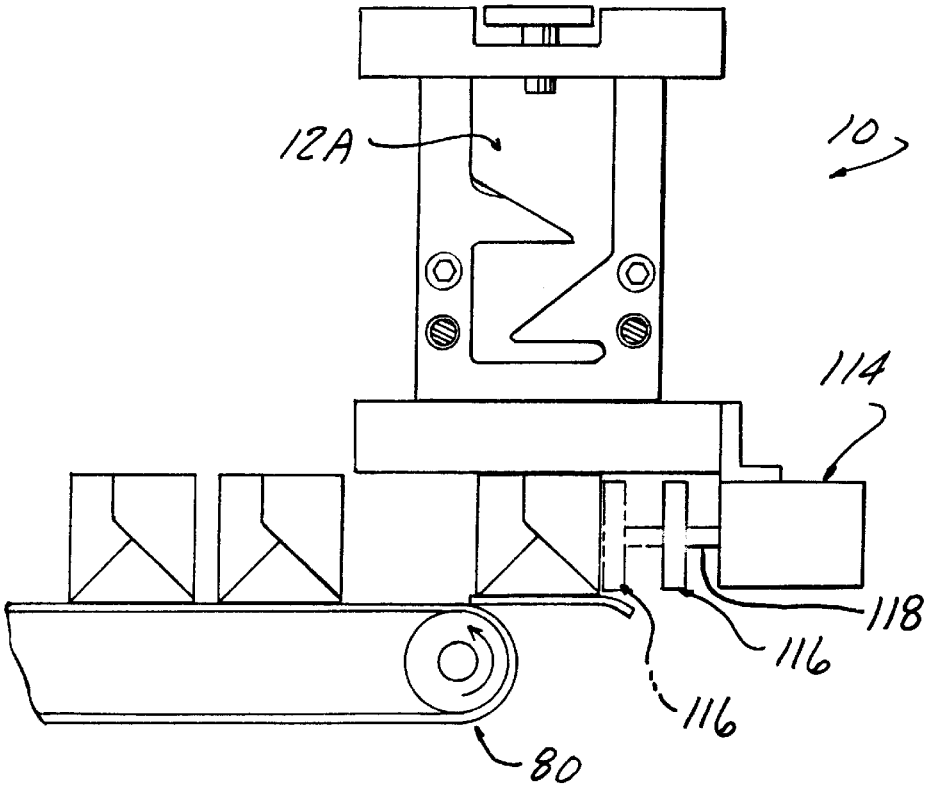
FIG. 10 is a diagrammatic end view of a folding frame equipped with an eject stop mechanism for insuring proper positioning of the product sticks in the folding frame.
Figure 11:
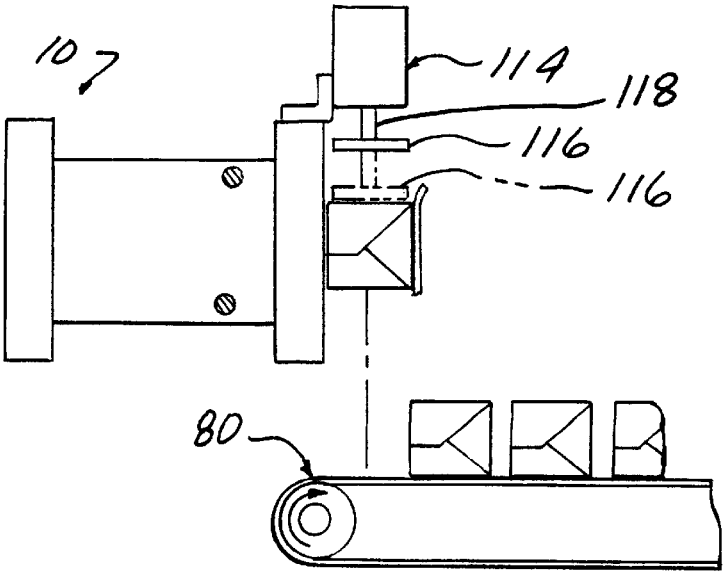
FIG. 11 is a diagrammatic end view of a horizontally oriented folding frame equipped with the eject stop mechanism of FIG. 10.

As an alternative, a positive stop can be employed as shown in FIG. 10. A power cylinder 114 has a plastic block 116 fixed to the end of the output rod 118. When the cylinder 114 is operated to extend the rod 118, the plastic block 116 is positioned below the cavity 12 of the folding frame 10 so as to prevent premature ejection of the next stick. The cylinder is operated to retract the block 116 and allow the stick to drop onto the conveyor 80, and then again extend the block 116 to avoid ejection of the next stick.

This arrangement can also be used with a horizontal orientation of the frame 10.

What is claimed is:

1. A wrapping apparatus for molding and wrapping stick shaped food product, comprising:

a shuttle molding plate having two spaced apart sets of four rectangular cavities, said shuttle movable back and forth between two shifted positions;

cavity filling means located at one of said shifted positions for alternately filling each set of cavities as said shuttle molding plate is shuttled back and forth to alternately bring each set of cavities in alignment with said cavity filling means;

two wrapping machines, each machine comprising a folding frame having four through cavities each aligned with a respective cavity set in said molding plate when said shuttle molding plate in a respective shifted position;

sheet feeding means for interposing sets of wrapping sheets between each mold cavity set and a respective wrapping machine;

pusher means for alternatively pushing product sticks from each cavity set and through a respective wrapping machine so as to wrap form food product sticks simultaneously, said wrapping machines each simultaneously wrapping four product sticks pushed through the respective cavities thereof.

2. The apparatus according to claim 1 wherein each of said wrapping machines comprises:

a pair of rectangular fold forming flat blades fixed to said folding frame at each end of an entry portion of each of said cavities, each blade having an end and two sides projecting into said associated cavity from a respective end of said cavity, with a clearance space between said frame cavity sides and said flat blade two sides of a width sufficient to receive a folded section of said wrapping sheet;

said blade projecting ends spaced apart a distance equal to the length of said food item and a thickness of said wrapping sheet;

a first set of two folding fingers fixed to said folding frame at one end of each of said cavities extending towards each other from opposite sides of said cavity at a position just beyond the end of a respective end of a food item end pushed into said cavity and below one of said flat blades;

a second set of two folding fingers fixed to said folding frame at another end of each of said cavities extending towards each other from opposite sides of said cavity at a position just beyond a respective end of a food item and below the other of said flat blades;

a pair of pusher shoes movably mounted beyond either end of each of said cavities, each having a blade portion aligned with a slot in each end of said forming frame extending orthogonally between said sides thereof and entering into said cavity;

actuator means for causing each pusher shoe to be moved so as to cause said blade portion to enter said associated cavity through said slots; and a pair of elongated top flap folding plates pivotally extending lengthwise along each of said cavities but disposed within a respective recess in a cavity side to not normally protrude into said cavity, each of said top flap folding plates pivotally mounted so as to be able to rotate down into said cavity from a retracted position to fold side portions of said wrapping sheet material into said cavity down onto said food item positioned at the bottom of said cavity.

* * * * *